US010962231B2

(12) United States Patent
Signorino et al.

(10) Patent No.: US 10,962,231 B2
(45) Date of Patent: Mar. 30, 2021

(54) PYROLYTIC OVEN WITH A LIGHTING MODULE

(71) Applicant: emz-Hanauer GmbH & Co. KGaA, Nabburg (DE)

(72) Inventors: Manfredi Signorino, Wackersdorf (DE); Johann Schenkl, Bodenwoehr (DE); Martin Brabec, Nabburg (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 180 days.

(21) Appl. No.: 16/148,363

(22) Filed: Oct. 1, 2018

(65) Prior Publication Data

US 2019/0107290 A1 Apr. 11, 2019

(30) Foreign Application Priority Data

Oct. 11, 2017 (DE) ..... 10 2017 009 427.6

(51) Int. Cl.

| | |
|---|---|
| ***F24C 14/02*** | (2006.01) |
| ***F24C 7/06*** | (2006.01) |
| ***F24C 9/00*** | (2006.01) |
| ***F24C 15/00*** | (2006.01) |

(52) U.S. Cl.

CPC ..... *F24C 14/02* (2013.01); *F24C 7/062* (2013.01); *F24C 9/00* (2013.01); *F24C 15/006* (2013.01); *F24C 15/008* (2013.01)

(58) Field of Classification Search

CPC .. F24C 14/02; F24C 7/062; F24C 7/06; F24C 9/00; F24C 15/006; F24C 15/008; F21Y 2115/10; F21V 29/50; F21V 29/67; F21V 33/0044; A47J 37/06

See application file for complete search history.

(56) References Cited

U.S. PATENT DOCUMENTS

2007/0131669 A1* 6/2007 Lee ..... F24C 15/006 219/396

FOREIGN PATENT DOCUMENTS

| | | | |
|---|---|---|---|
| DE | 102009002775 | A1 | 11/2010 |
| DE | 102009027912 | A1 | 1/2011 |
| DE | 202015104659 | U1 | 12/2015 |

(Continued)

OTHER PUBLICATIONS

DE Office Action in co-pending German application No. 10 2017 009 427.6 dated Sep. 7, 2018.

*Primary Examiner* — Shawntina T Fuqua

(74) *Attorney, Agent, or Firm* — Robert R. Deleault, Esq.; Mesmer & Deleault, PLLC

(57) ABSTRACT

A pyrolytic oven comprises a housing and a muffle delimiting a cooking chamber inside the housing. A lighting module serves to illuminate the cooking chamber, wherein the lighting module has a cooling structure with an arrangement of cooling extensions formed in particular as pins or ribs, which project into a gap between housing and muffle and have a convection effect in a cooking mode of the oven. A fan device of the oven is configured and controlled to generate an air flow encountering the cooling structure in the gap in a pyrolytic mode of the oven. The cooling structure of the lighting module further has a wall formation, which in pyrolytic mode generates a wind shadow relative to the air flow for a number of cooling extensions of the cooling structure arranged distributed in a transverse plane to the flow direction of the air flow.

14 Claims, 3 Drawing Sheets

(56) References Cited

FOREIGN PATENT DOCUMENTS

| | | | |
|---|---|---|---|
| DE | 212014000251 | U1 | 10/2016 |
| EP | 0913646 | * | 5/1999 |

* cited by examiner

PYROLYTIC OVEN WITH A LIGHTING MODULE

BACKGROUND OF THE INVENTION

1. Field of the Invention

The present invention relates generally to a pyrolytic oven with a lighting module for illuminating a cooking chamber provided in the oven.

2. Description of the Prior Art

Ovens are generally used for the preparation of foods, which are cooked due to the effect of heat. In a cooking mode of the oven, temperatures of up to 300° C. are usually attained in a cooking chamber of the oven. To provide a self-cleaning function it is further known to operate the oven in another operating mode, in which cleaning of the cooking chamber takes place by means of pyrolysis. In this case the temperature in the cooking chamber is increased to up to 500° C., due to which pyrolytic decomposition of undesirable baking residues is achieved.

Light-emitting diodes are used increasingly as lamps in ovens on account of their advantageous properties. Their energy density and efficiency, i.e. the proportion of converted light relative to the electrical power supplied to the light-emitting diodes, is higher by a multiple compared to light bulbs. However, the use of light-emitting diodes calls for effective heat management, as their lighting intensity and service life decrease with increasing temperatures.

Lamps used in a pyrolytic oven run the risk in pyrolytic mode of being exposed to particularly high temperatures, which is a problem for the use of light-emitting diodes in particular.

SUMMARY OF THE INVENTION

It is an object of the present invention to provide a pyrolytic oven that avoids overheating of a light source used therein to illuminate a cooking chamber.

The present invention achieves these and other objectives by providing a pyrolytic oven having a housing and a muffle delimiting a cooking chamber inside the housing. A muffle interior forming the cooking chamber is preferably accessible via an oven door mounted on the housing, which door is used to close the muffle. Between the housing and the muffle, the oven is provided with a gap for the thermal separation of the muffle from the housing. The oven further comprises a fan device, which is configured and controlled to generate an air flow in the gap. In this way a heat input into the housing induced by the muffle can be limited and thus excessive heating of the housing can be prevented.

A lighting module of the oven is used to illuminate the cooking chamber. To this end the lighting module comprises preferably at least one light source in the form of a light-emitting diode. The lighting module can be inserted into a wall section of the muffle, wherein the light-emitting diode is preferably arranged in the region of the wall section receiving the lighting module.

The lighting module has a cooling structure with an arrangement of cooling extensions formed in particular as pins or ribs, which project into the gap between housing and muffle and have a convection effect in a cooking mode of the oven. The cooling extensions permit a removal of heat from the lighting module in the direction of the gap in cooking mode. To this end the fan device can be configured and controlled to generate an air flow in the gap that encounters the cooling structure in cooking mode.

In the oven the fan device is configured and controlled to generate an air flow in the gap that encounters the cooling structure in a pyrolytic mode. Excessive heating of the lighting module in pyrolytic mode is avoided in this way.

In pyrolytic mode the cooking chamber formed by the muffle has a higher temperature compared to the cooking mode, for example a temperature in the range between 480° C. and 500° C. The high temperatures prevailing in pyrolytic mode cause the air flow to heat up much more strongly on flowing through the gap in pyrolytic mode compared to the cooking mode. For example, the temperature of the air flow flowing through the gap in pyrolytic mode can be above 140° C. and thus above a maximum permissible temperature of a light-emitting diode. An air flow flowing through the gap that is heated in such a manner in pyrolytic mode is thus not helpful for adequate cooling of the lighting module. On the contrary, an air flow heated in such a manner and encountering the cooling structure causes an undesirable additional heat input into the lighting module.

To prevent an excessive heat input into the lighting module during the pyrolytic mode, the cooling structure of the lighting module has a wall formation, which in pyrolytic mode produces a wind shadow relative to the air flow for a number of cooling extensions of the cooling structure arranged distributed in a transverse plane to the flow direction of the air flow. In other words, the wall formation can be formed in such a way and provided so as to deflect the air flow flowing through the gap away from the cooling extensions and to keep it away from these in pyrolytic mode.

Because the lighting module comprises the wall formation, the present invention prevents an excessive heat input from the air flow in the direction of the cooling structure of the lighting module during pyrolytic mode. In particular, a heat flow transferred by forced convection can be reduced in this way in pyrolytic mode. As a result, the wall formation counteracts overheating of the lighting module and an accompanying impairment of the service life and lighting intensity of the lighting module. At the same time, the structure of the lighting module makes it possible for the heat flow transferred in cooking mode via the cooling structure from the lighting module in the direction of the air flow by means of free and forced convection to be sufficiently great to cool a light-emitting diode contained therein adequately and so prevent overheating of the same.

In particular, when looking in the flow direction of the air flow in pyrolytic mode, the wall formation can have a flow cross section that is larger by a multiple, for example at least 5-fold or at least 10-fold, than each cooling extension of the cooling structure.

In a further development, the wall formation can comprise a wall section that in pyrolytic mode generates a wind shadow for at least a predominant number, in particular the total number, of the cooling extensions. In other words, the wall formation can be provided to deflect the air flow flowing through the gap in pyrolytic mode away from the predominant number or the total number of the cooling extensions. A direct flow onto the predominant number or the total number of cooling extensions by the air flow in pyrolytic mode can thus be prevented.

The wall formation can be formed by a single continuously connected wall section. It is also conceivable, however, that the wall formation is formed of several wall sections, between which a gap indeed exists, but which overlap one another and therefore act in flow technology terms like a single, continuous deflector surface for the air flow in pyrolytic mode. For example, the wall formation can have a wall section formed in the manner of a curly bracket, the central web of which faces the air flow in pyrolytic operation of the oven.

The cooling extensions are preferably formed so that in pyrolytic mode the cooling extensions stand substantially along their entire height and/or width in the wind shadow of the wall formation. In the present case the height and width of the cooling extensions are understood as an extension of the same in the transverse plane to the flow direction of the air flow. An extension of the cooling extensions in the direction of their height is transverse here to an extension in the direction of their width, wherein their extension in a height direction is usually greater than in the width direction.

In a further development the cooling extensions can be arranged distributed in a two-dimensional regular lattice. In addition, the wall formation can have a wall section that extends in one of the two lattice dimensions in a continuously connected manner over the entire lattice width measured in this lattice dimension and if desired beyond this. This lattice dimension that is relevant for the measurement of the lattice width is preferably arranged in the transverse plane to the flow direction of the air flow.

The cooling extensions can be manufactured from aluminium or aluminium oxide. The wall formation is preferably produced from the same material as the cooling extensions, in particular from aluminium or aluminium oxide. Alternatively the wall formation can be manufactured from another material, for example from a material with a lower thermal conduction coefficient to the material contained in the cooling extensions, such as a ceramic material, for example.

Alternatively or in addition, the wall formation can stand up above a base plate of the cooling structure, above which the cooling extensions also stand up in particular with a perpendicular orientation to a plate plane of the base plate. The wall formation can be manufactured in one piece continuously with the cooling extensions and the base plate. The base plate can have an approximately circular plate outline. Alternatively, the base plate can have a plate outline of any shape, for example an approximately rectangular or an oval plate outline. The base plate can be attached to a rear side of a circuit board, on the front side of which at least one light source, for example at least one light-emitting diode, of the lighting module is arranged.

In general, the heat transfer provided via the cooling structure is a function of a thermal resistance of the cooling structure. This connection is described by the following relationship (1):

(1)

$$Q = \frac{1}{R_{th}} \times \Delta T \tag{1}$$

in which Q [W] defines a heat flow transferred between the lighting module and the air flow, $R_{th}$ [K/W] defines a thermal resistance of the cooling structure for the heat transfer between the lighting module and the air flow and ΔT[K] defines the temperature difference between the cooling structure and the air flow.

In a heat transfer by means of forced convection, the thermal resistance of the cooling structure is substantially influenced by the so-called heat transfer coefficient, which represents a specific index for the heat transfer in the region of a boundary layer between the cooling structure and the air flow. As the heat transfer coefficient increases, the thermal resistance declines. The heat transfer coefficient is a function in this case of the flow velocity, the nature of the flow, i.e. laminar or turbulent flow, the geometrical conditions, e.g. the resistance coefficient of the cooling structure in relation to the flow direction of the air flow, and the surface composition of the cooling structure.

In a further development, the oven can be configured to influence at least one of the parameters described above in order to adjust a thermal resistance of the cooling structure and thus the heat transfer, in particular a heat flow between the cooling structure and the air flow. This can take place as a function of the operating mode of the oven. The oven can accordingly be configured and controlled so that a thermal resistance of the cooling structure in cooking mode is set to be greater than in pyrolytic mode of the oven.

For example, the fan device can be configured and controlled to generate the air flow also in cooking mode of the oven, but with a flow direction that is changed compared to pyrolytic mode, due to which the cooling extensions lie outside the wind shadow of the wall formation. This can have the result that the resistance coefficient of the cooling structure is increased in relation to the flow direction of the air flow in cooking mode and/or a proportion of turbulent flow of the cooling flow conducted over the cooling structure is increased. In this way a heat transfer coefficient can be set that is higher in cooking mode by comparison with the pyrolytic mode and thus a lower thermal resistance can be set. Alternatively or in addition, the cooling structure can be arranged movably between various positions, of which a first position brings about a position of the number of cooling extensions in the wind shadow of the wall formation and a second position brings about a position of the number of cooling extensions outside the wind shadow of the wall formation with an unchanged flow direction of the air flow.

Preferred embodiments of the invention are now explained in greater detail with reference to the enclosed schematic drawings.

DETAILED DESCRIPTION OF THE INVENTION

Figure 1:
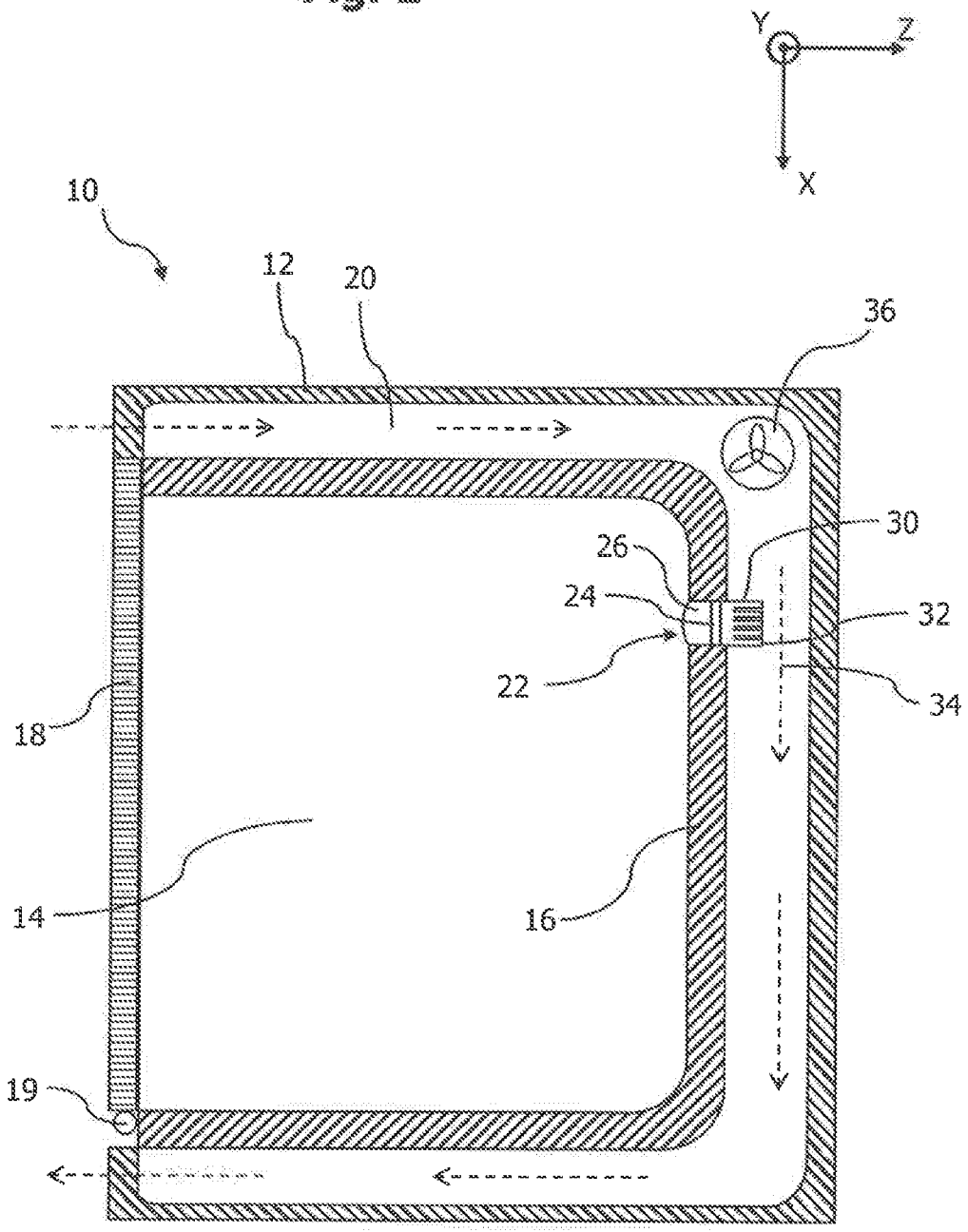
FIG. 1 shows a side view of a pyrolytic oven in a vertical section.

A pyrolytic oven 10 shown in FIG. 1 comprises a housing 12 and a muffle 16 delimiting a cooking chamber 14 inside the housing 12. The muffle 16 is accessible via an oven door 18 mounted on the housing 12, which door is mounted pivotably on the housing 12 about a horizontal shaft 19 between a position closing the cooking chamber 14 and a position releasing the latter. The oven door 18 is provided with a viewing window, through which a user can look into the cooking chamber 14. The oven 10 further comprises a control unit, which is not shown here and which executes control functions of the oven 10 and is preferably accommodated above the muffle 16 and inside the housing 12. The oven 10 is provided with a gap 20 between the housing 12 and the muffle 16.

Figure 2:
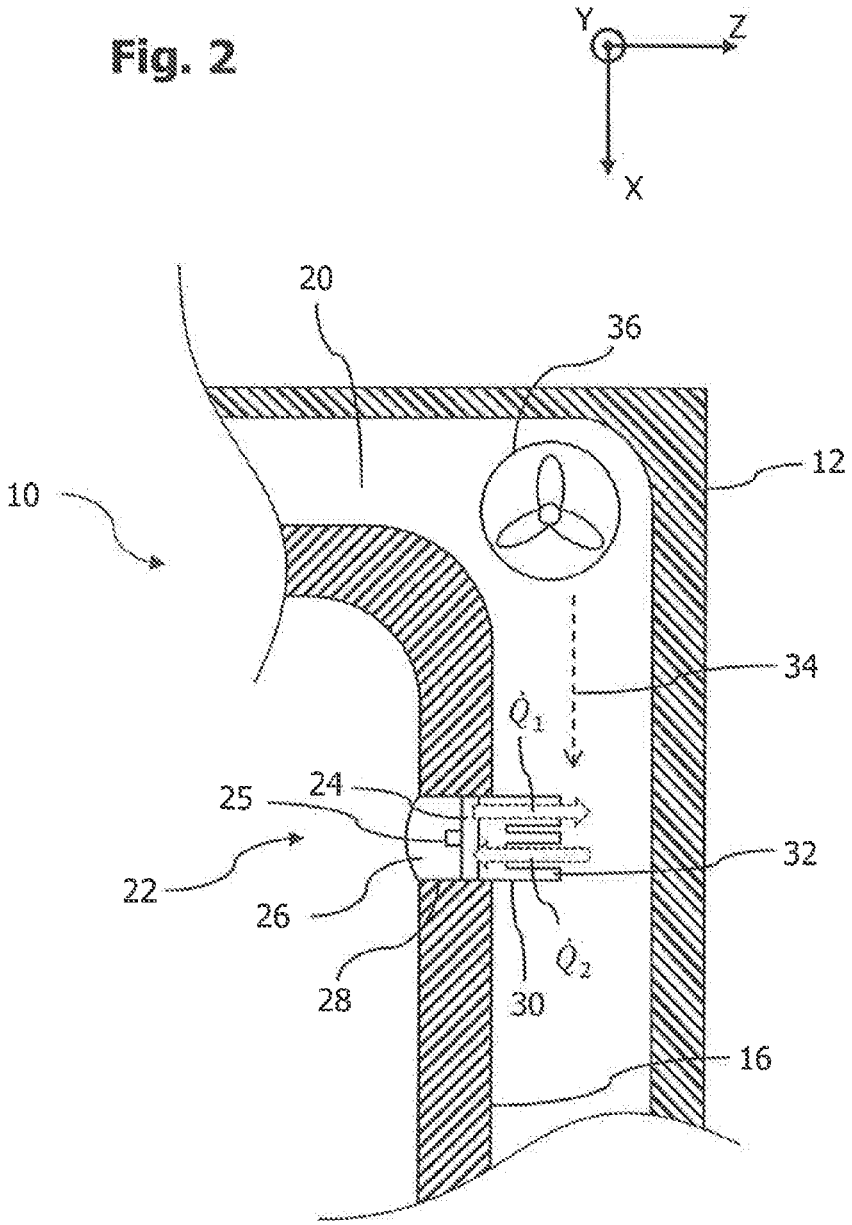
FIG. 2 shows an enlarged extract of the pyrolytic oven shown in FIG. 1 with a lighting module inserted therein.

A lighting module 22 of the oven 10 is used to illuminate the cooking chamber 14 and is inserted into a wall section of the muffle 16. The lighting module 22 comprises at least one circuit board 24, on the front side of which facing the cooking chamber 14 at least one light-emitting diode 25 (FIG. 2) is provided for emitting light, and a lens 26 (including a window glass, at which the light emerges into the cooking chamber 14) for guiding the beam and for thermal insulation of the light-emitting diode 25 from the cooking chamber 14. In the present case the lighting module 22 is inserted in a side wall of the muffle 16 lying opposite the oven door 18. Alternatively, the lighting module 22 can be inserted into a side wall adjoining the oven door 18 or ceiling wall of the muffle 16. As shown in FIG. 2, the wall section of the muffle 16 taking up the lighting module 22 comprises a receiving opening 28, into which the lighting module 22 is inserted. The circuit board 24 with the at least one light-emitting diode 25 is taken up in the receiving opening 28 of the wall section. The oven 10 is configured and controlled so that the light-emitting diode of the lighting module 22 is switched on in a cooking mode of the oven 10, so that light emitted by this illuminates the cooking chamber, and is switched off in pyrolytic mode of the oven 10.

The lighting module 22 has a cooling structure 30 with an arrangement of cooling extensions 32, which project into the gap 20 between housing 12 and muffle 16 and have a convection effect in a cooking mode of the oven 10. The cooling extensions 32 are formed in the present case in the shape of pins. Alternatively, the cooling extensions 32 can be formed in the shape of ribs. The cooling structure 30 is used to transfer heat between the lighting module 22, in particular the light-emitting diode, and an air flow 34 flowing through the gap 20.

A fan device 36 of the oven 10 is used to generate the air flow 34 in the gap 20 in operation of the oven 10. In particular, the fan device 36 is configured and controlled to generate an air flow 34 encountering the cooling structure 30 in the gap 20 in cooking mode and in pyrolytic mode of the oven 10. To do this the fan device 36 supplies the gap 20 with outside air from an environment of the oven 10 as cooling air via a cooling air inlet, which is not shown here, and conducts this in the form of the air flow 34 through the gap 20. After flowing through the gap 20, the air flow 34 generated thus is conducted via a cooling air outlet, not shown here, into the environment of the oven 10.

In cooking mode of the oven 10, the light-emitting diode 25 is switched on, so that a heat input induced by a power loss of the light-emitting diode takes place into the lighting module 22. The temperature inside the lighting module 22 increases in this way. Because the air flow 34, which has a lower temperature in the cooking mode than the lighting module 22, flows towards the cooling structure 30, a heat transfer takes place from the cooling structure 30 in the direction of the air flow 34 and thus cooling of the lighting module 22 occurs. In other words, in cooking mode a first heat flow $Q_1$ is generated by the lighting module 22 in the direction of the air flow 34.

Figure 3:
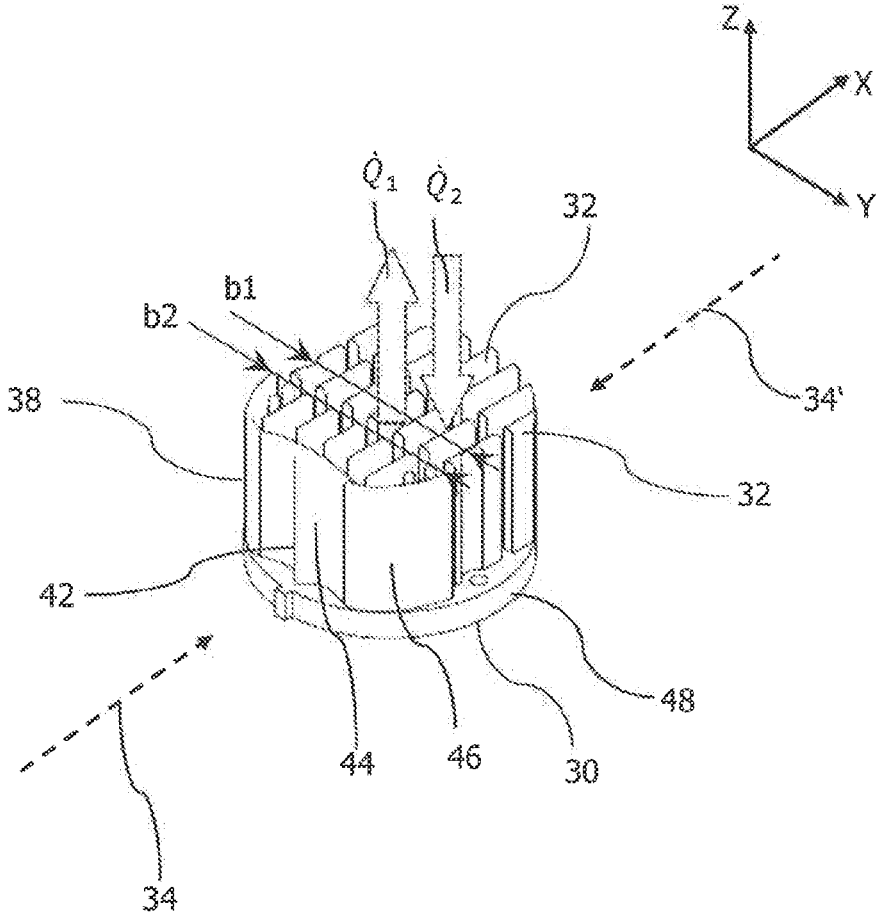
FIG. 3 shows a view in perspective of a cooling structure of the lighting module shown in FIG. 2.

In the pyrolytic mode of the oven 10, temperatures of between 480° C. and 500° C. are reached in the cooking chamber 14. This leads to the air flow 34 heating up much more strongly in comparison with the cooking mode on flowing through the gap 20 and reaching temperatures of over 140° C. in the region of the cooling structure 30 of the lighting module 22, which is above a maximum temperature permissible for the light-emitting diode. In pyrolytic mode a second heat flow $Q_2$ is thus generated by the air flow 34 in the direction of the lighting module 22. To counteract overheating of the lighting module 22 in pyrolytic mode, the cooling structure 30 further comprises a wall section 38, which is shown in FIG. 3 and in pyrolytic mode generates a wind shadow relative to the air flow 34 for a number of cooling extensions 32 of the cooling structure 30, which are arranged distributed in a transverse plane to the flow direction X of the air flow 34. In the present case the transverse plane is a plane spanned by a longitudinal direction Z and a transverse direction Y normal thereto of the cooling structure 30. The flow direction X is respectively normal here to the longitudinal direction Z and the transverse direction Y. When looking in the flow direction X of the air flow 34 in pyrolytic mode, the wall section 38 has a flow cross section that is larger by a multiple, for example at least 5-fold or at least 10-fold, than each cooling extension 32 of the cooling structure 30.

The wall section 38 produces a wind shadow for the total number of cooling extensions 32 in pyrolytic mode. It is formed approximately in the manner of a curly bracket (i.e. "{"). A central web 42 of the wall section 38 faces the air flow 34 in pyrolytic mode of the oven 10. As shown in FIG. 3, the wall section 38 comprises two adjoining first sections 44 curved in the direction of the cooling extensions 32, which sections form the central web 42. At ends of the first sections 44 facing away from the central web 42, these respectively adjoin second sections 46 curved in the opposite direction compared with the first section 44. This configuration of the wall section 38 has the effect that the air flow 34 encountering the wall section 38 in the flow direction X is conducted in a very largely laminar manner around the cooling extensions 32.

The cooling extensions 32 are formed so that in pyrolytic mode the cooling extensions 32 stand substantially along their entire height, i.e. along their extension in the longitudinal direction Z, and/or width, i.e. along their extension in transverse direction Y, in the wind shadow of the wall section 38.

The cooling extensions 32 are arranged distributed in a two-dimensional regular lattice. The two-dimensional lattice extends in the present case along the flow direction X and the transverse direction Y. The wall section 38 extends here in the lattice dimension along the transverse direction Y continuously connected over the entire lattice width b1 measured in this lattice dimension and beyond. In other words, the wall section 38 has a width b2 that is greater along the transverse direction Y compared with the lattice width b1. It is manufactured from the same material as the cooling extensions 32, e.g. from aluminium or aluminium oxide. Alternatively, the wall section 38 can be manufactured from another material compared with the cooling extensions 32.

The wall section 38 stands up above a base plate 48 of the cooling structure 30, above which the cooling extensions 32 also stand up with a substantially perpendicular orientation to the plate plane of the base plate 48. The wall section 38 is produced in one piece continuously with the cooling extensions 32 and the base plate 48. The base plate 48 has an approximately circular plate outline and is attached to a rear side of the circuit board 24, on the front side of which the at least one light-emitting diode 25 of the lighting module 22 is arranged.

On account of the higher temperature of the air flow 34 in pyrolytic mode as compared to the cooking mode, a difference between the temperature prevailing in the light-emitting diode 25 and the temperature of the air flow 34 is smaller in pyrolytic mode than in cooking mode. This has the effect that the second heat flow $Q_2$ transferred in pyrolytic mode is smaller in amount than the first heat flow $Q_1$ transmitted in cooking mode. The present arrangement accordingly facilitates adequate cooling of the lighting module 22 in cooking mode and at the same time adequate protection against an excessive heat input into the lighting module 22 in pyrolytic mode.

To amplify this technical effect, the oven 10 can further be configured and controllable so that a thermal resistance of the cooling structure 30 is set to be greater in the heat transfer between lighting module 22 and the air flow 34 in cooking mode than in pyrolytic mode of the oven 10. To this end the fan device 36 can be configured and controllable to generate an air flow 34' in the cooking mode of the oven 10 with a changed flow direction compared with the pyrolytic mode, due to which the cooling extensions 32 lie outside the wind shadow of the wall section 38. The air flow 34' generated in cooking mode flows counter to the flow direction X of the air flow 34 in pyrolytic mode, as shown in FIG. 3. In this way a higher heat transfer coefficient and thus a lower thermal resistance can be set in cooking mode as compared with pyrolytic mode. Alternatively or in addition, the cooling structure 30 can be arranged movably between various positions, of which a first position brings about a position of the number of cooling extensions 32 in the wind shadow of the wall section 38 and a second position brings about a position of the number of cooling extensions 32 outside the wind shadow of the wall section 38 with an unchanged flow direction of the air flow 34. For example, the cooling structure 30 can be rotatable by means of an actuation unit about the longitudinal direction Z, so that the cooling inserts 32 can be positioned in the wind shadow generated by the wall section 38 or outside the same.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A pyrolytic oven adapted to be selectively operated in a cooking mode and a pyrolytic mode, the oven comprising:

a housing;

a muffle delimiting a cooking chamber inside the housing;

a lighting module for illuminating the cooking chamber, wherein the lighting module has a cooling structure including a wall formation and a plurality of cooling extensions, the plurality of cooling extensions projecting into a gap between the housing and the muffle and transverse to an air flow direction within the gap and, when the oven is operated in the cooking mode, having a convection effect; and a fan device, which is configured and controlled to generate, when the oven is operated in the pyrolytic mode, an air flow encountering the cooling structure in the gap, wherein the wall formation of the cooling structure generates a wind shadow relative to the air flow when the oven is operated in the pyrolytic mode, wherein one or more of the plurality of cooling extensions are arranged to extend into the wind shadow generated by the wall formation.

2. The pyrolytic oven according to claim 1, wherein, when looking in the flow direction of the air flow in the pyrolytic mode, the wall formation has a flow cross section that is larger by a multiple than each cooling extension of the cooling structure.

3. The pyrolytic oven according to claim 1, wherein the wall formation comprises a wall section, which in the pyrolytic mode, generates a wind shadow for at least a predominant number of the cooling extensions.

4. The pyrolytic oven according to claim 1, wherein the wall formation is formed by a single, continuously connected wall section.

5. A pyrolytic oven comprising:

a housing;

a muffle delimiting a cooking chamber inside the housing;

a lighting module for illuminating the cooking chamber, wherein the lighting module has a cooling structure with an arrangement of cooling extensions, which project into a gap between the housing and the muffle and have a convection effect in a cooking mode of the oven; and a fan device, which is configured and controlled to generate an air flow encountering the cooling structure in the aa in a pyrolytic mode of the oven, wherein the cooling structure of the lighting module includes a wall formation, which in the pyrolytic mode generates a wind shadow relative to the air flow for a number of cooling extensions of the cooling structure arranged distributed in a transverse plane to the flow direction of the air flow, wherein the wall formation has a wall section formed in the manner of a curly bracket, the central web of which faces the air flow in the pyrolytic mode of the oven.

6. A pyrolytic oven comprising:

a housing;

a muffle delimiting a cooking chamber inside the housing;

a lighting module for illuminating the cooking chamber, wherein the lighting module has a cooling structure with an arrangement of cooling extensions, which project into a gap between the housing and the muffle and have a convection effect in a cooking mode of the oven; and a fan device, which is configured and controlled to generate an air flow encountering the cooling structure in the gap in a pyrolytic mode of the oven, wherein the cooling structure of the lighting module includes a wall formation, which in the pyrolytic mode generates a wind shadow relative to the air flow for a number of cooling extensions of the cooling structure arranged distributed in a transverse plane to the flow direction of the air flow, wherein the cooling extensions stand in the pyrolytic mode substantially along their entire height in the wind shadow of the wall formation.

7. A pyrolytic oven comprising:

a housing;

a muffle delimiting a cooking chamber inside the housing;

a lighting module for illuminating the cooking chamber, wherein the lighting module has a cooling structure with an arrangement of cooling extensions, which project into a gag between the housing and the muffle and have a convection effect in a cooking mode of the oven; and a fan device, which is configured and controlled to generate an air flow encountering the cooling structure in the gap in a pyrolytic mode of the oven, wherein the cooling structure of the lighting module includes a wall formation, which in the pyrolytic mode generates a wind shadow relative to the air flow for a number of cooling extensions of the cooling structure arranged distributed in a transverse plane to the flow direction of the air flow, wherein the cooling extensions are arranged distributed in a two-dimensional regular lattice and the wall formation has a wall section, which extends in one of the two lattice dimensions continuously connectedly over the entire lattice width measured in this lattice dimension.

8. The pyrolytic oven according to claim 1, wherein the wall formation is manufactured from the same material as the cooling extensions.

9. A pyrolytic oven comprising:

a housing;

a muffle delimiting a cooking chamber inside the housing;

a lighting module for illuminating the cooking chamber, wherein the lighting module has a cooling structure with an arrangement of cooling extensions, which project into a gap between the housing and the muffle and have a convection effect in a cooking mode of the oven; and a fan device, which is configured and controlled to generate an air flow encountering the cooling structure in the gap in a pyrolytic mode of the oven, wherein the cooling structure of the lighting module includes a wall formation, which in the pyrolytic mode generates a wind shadow relative to the air flow for a number of cooling extensions of the cooling structure arranged distributed in a transverse plane to the flow direction of the air flow, wherein the wall formation stands up above a base plate of the cooling structure, above which the cooling extensions also stand up with an orientation perpendicular to the plate plane.

10. The pyrolytic oven according to claim 9, wherein the wall formation is manufactured in one piece continuously with the cooling extensions and the base plate.

11. The pyrolytic oven according to claim 9, wherein the base plate has an approximately circular plate outline.

12. The pyrolytic oven according to claim 9, wherein the base plate is attached to a rear side of a circuit board, on the front side of which at least one light source of the lighting module is arranged.

13. The pyrolytic oven according to claim 1, wherein the fan device is configured and controlled to generate the air flow also in cooking mode of the oven, but with a changed flow direction compared with the pyrolytic mode, due to which the cooling extensions lie outside the wind shadow of the wall formation.

14. A pyrolytic oven comprising:

a housing;

a muffle delimiting a cooking chamber inside the housing;

a lighting module for illuminating the cooking chamber, wherein the lighting module has a cooling structure with an arrangement of cooling extensions, which project into a gap between the housing and the muffle and have a convection effect in a cooking mode of the oven; and a fan device, which is configured and controlled to generate an air flow encountering the cooling structure in the gap in a pyrolytic mode of the oven, wherein the cooling structure of the lighting module includes a wall formation, which in the pyrolytic mode generates a wind shadow relative to the air flow for a number of cooling extensions of the cooling structure arranged distributed in a transverse plane to the flow direction of the air flow, wherein the cooling structure is arranged movably between various positions, of which a first position brings about a position of the number of cooling extensions in the wind shadow of the wall formation and a second position brings about a position of the number of cooling extensions outside the wind shadow of the wall formation with an unchanged flow direction of the air flow.

* * * * *